US005110019A

United States Patent [19]

Kolton et al.

[11] Patent Number: 5,110,019

[45] Date of Patent: May 5, 1992

[54] GARMENT ACCESSORY HANGER FOR TIES OR SCARFS WITH PLURAL OPENINGS AND SPECIAL HOOK

[75] Inventors: Chester Kolton, Westfield; Stuart S. Spater, Livingston, both of N.J.

[73] Assignee: B&G Plastics, Inc., New York, N.Y.

[21] Appl. No.: 619,028

[22] Filed: Nov. 28, 1990

[51] Int. Cl.[5] ..... A47G 25/74

[52] U.S. Cl. ..... 223/87; 223/85; 223/DIG. 1; 223/DIG. 4; D6/315

[58] Field of Search ..... 223/DIG. 1, DIG. 4, 223/85, 88, 81, 82, 87, DIG. 2; 206/289, 290, 292, 293, 294, 295; D6/315

[56] References Cited

U.S. PATENT DOCUMENTS

| | | | |
|---|---|---|---|
| D. 254,644 | 4/1980 | Abramowitz | 223/DIG. 1 X |
| D. 259,164 | 5/1981 | Abramowitz | D6/315 |
| 2,164,941 | 7/1939 | Rentchler | 223/DIG. 4 X |
| 2,264,957 | 12/1941 | Shafarman | 223/87 |
| 3,243,087 | 3/1966 | Pulitzer | 223/87 |
| 3,246,812 | 4/1986 | Walker et al. | 223/87 |
| 3,783,995 | 1/1974 | Tobin | 223/DIG. 1 X |
| 4,765,467 | 8/1988 | Kolton et al. | 223/DIG. 1 X |

*Primary Examiner*—Werner H. Schroeder

*Assistant Examiner*—Bibhu Mohanty

*Attorney, Agent, or Firm*—Robin, Blecker, Daley & Driscoll

[57] ABSTRACT

A garment accessory hanger comprises an integral frame having a hook portion and a body portion, the body portion defining an upper transverse marginal course, a lower transverse marginal course and opposed first and second side marginal courses interconnecting the upper and lower transverse marginal courses, and first and second deflectable arms extending respectively from the first and second side marginal courses, ends of the arms being mutually spaced, the upper transverse marginal course and the first and second arms bounding a first opening in the body portion, the lower transverse marginal course and the first and second arms bounding a second opening in the body portion, the first opening being of lesser area than the second opening, the first and second arms having respective surfaces bounding the first opening which are parallel with an undersurface of the upper transverse marginal course bounding the first opening, the first and second arms having respective surfaces bounding the second opening which extend at an acute angle with respect to an upper surface of the lower transverse marginal course bounding the second opening.

5 Claims, 1 Drawing Sheet

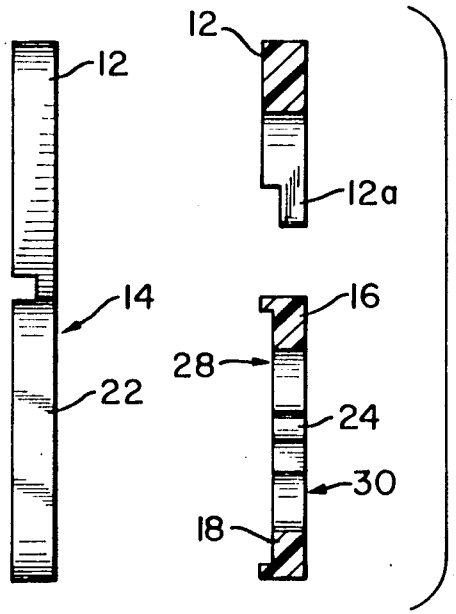
FIG. 5
FIG. 2
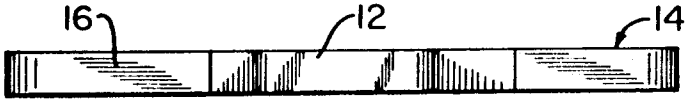
FIG. 3
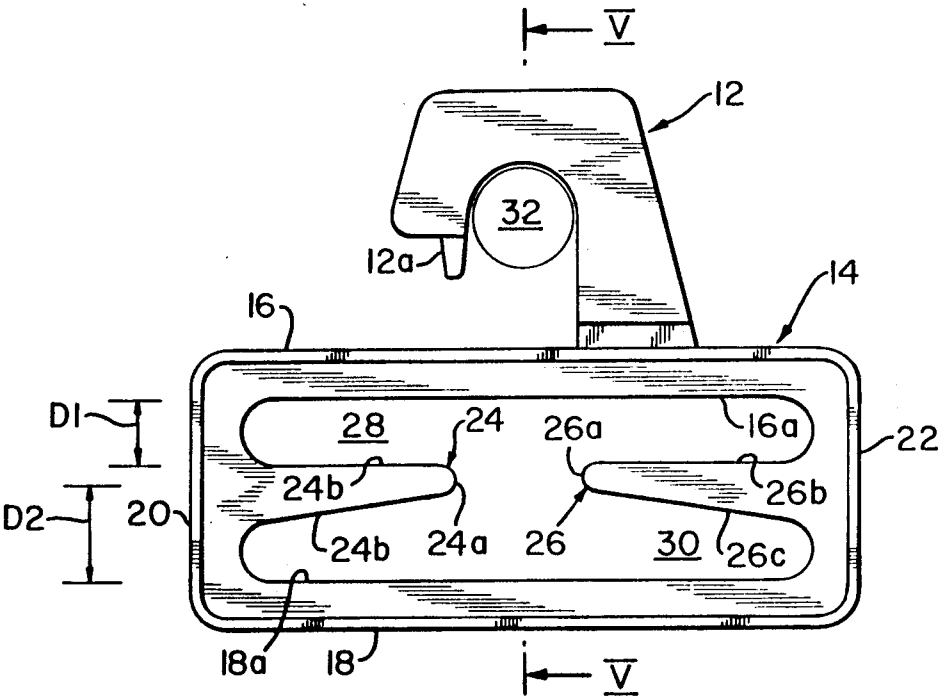
FIG. 1
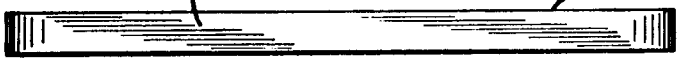
FIG. 4

GARMENT ACCESSORY HANGER FOR TIES OR SCARFS WITH PLURAL OPENINGS AND SPECIAL HOOK

FIELD OF THE INVENTION

This invention relates to a garment accessory hanger such as for the hanging of ties, scarfs and like elongate articles of clothing.

BACKGROUND OF THE INVENTION

A commercially-known accessory hanger is integrally formed of plastic and includes a hook portion and a body portion, the latter having upper and lower symmetrical openings bounded by the upper and lower margins of the body portion and arms extending from the body side margins and having ends spaced from one another to provide a passage between the upper and lower openings.

The arms are deflectable out of the plane of the body portion and a looped portion of an accessory is applied to the arms. As the arms return under self-bias into the plane of the body portion, the garment is retained and may be displayed by placing the hook portion on a display rod.

From applicants' viewpoint, the described commercial hanger is not as effective as desired in respect of securely retaining accessories. Thus, ties or scarfs come to be readily disengaged from the hanger, as by slipping over and beyond the arms.

A further disadvantage of the commercial hanger is that its hook portion is seen as too readily separable from a display rod.

SUMMARY OF THE INVENTION

The present invention has as its object the provision of an improved hanger of the type under discussion.

In attaining this and other objects, the invention introduces several modifications in the commercially-known hanger. In a first respect, whereas the upper and lowef openings thereof are equal size, the hanger of the invention provides for disparity in the sizes of the openings. Further, whereas the commercially-known hanger arms are each of symmetrical configuration, being of generally triangular shape, the invention introduces a dissymmetry in the configuration of the arms. As will be discussed, each of these modifications contributes to heightened retention of accessories with the hanger.

In another aspect, the invention introduces a modification in the hanger hook portion which is found to enhance maintenance of the hanger with the display rod while yet permitting ready removability of the hanger from the display rod when desired.

The foregoing and other features of the invention will be further understood from the following detailed description of a preferred embodiment thereof and from the drawings wherein like reference numerals identify like components and parts throughout.

DESCRIPTION OF THE DRAWINGS

FIG. 1 is a front elevation of a hanger in accordance with the invention.

FIG. 2 is a right side elevation of the FIG. 1 hanger.

FIG. 3 is top plan view of the FIG. 1 hanger.

FIG. 4 is a bottom view of the FIG. 1 hanger.

FIG. 5 is a sectional view of the FIG. 1 hanger as would be seen from plane V—V of FIG. 1.

DETAILED DESCRIPTION OF THE PREFERRED EMBODIMENT

Referring to FIGS. 1–4, hanger 10 is comprised of an integral frame having a hook portion 12 and a body portion 14, the body portion defining an upper transverse marginal course 16, a lower transverse marginal course 18 and opposed first and second side marginal courses 20 and 22 interconnecting the upper and lower transverse marginal courses.

First and second deflectable arms 24 and 26 extend respectively from first and second side marginal courses 20 and 22, ends **24*a* and 24*a*** of the arms being mutually spaced.

Upper transverse marginal course 16 and first and second arms 24 and 26 bound a first opening 28 in body portion 14. Lower transverse marginal course 18 and first and second arms 24 and 26 bound a second opening 30 in body portion 14.

First opening 28 is of substantially lesser area than the second opening 30 per the invention, for purposes and effect below discussed. Further, in accordance with invention first and second arms 24 and 26 have respective surfaces **24*b* and 26*b* bounding the first opening which are parallel with undersurface 16*a* of upper transverse marginal course 16 bounding first opening 28. Also, first and second arms 24 and 26 having respective surfaces 24*c* and 26*c* bounding second opening 30 which extend at an acute angle with respect to upper surface 18*a* of lower transverse marginal course 18 bounding second opening 30**.

First opening 28 is of oval configuration and second opening 30 is of triangular configuration. A transverse dimension D1 of the oval is substantially less than and generally one-half of the height D2 of the triangle.

Hook portion 12 is of a first thickness generally thoughout its expanse, with a tail **12*a* of second thickness less than the first thickness at a free end of hook portion 12. Tail portion 12*a*, as is seen in FIG. 1, has substantially less width in the plane of FIG. 1 than the parent part of hook portion 12** from which it depends.

It is found that the above-discussed configurational and size diversity as between openings 28 and 30 gives rise to enhanced frictional relation between a tie or scarf inserted loopwise onto arms 24 and 26. Particularly, with surfaces **24*b* and 26*b* extending in parallel with surface 16*a* and closely spaced relative thereto, heightened friction exists atop the arms as between surfaces 24*b* and 26*b* and the accessory. Also, the increased acute angle, over that obtaining in the commercially-known hanger above discussed, of surfaces 24*c* and 26*c* with respect to surface 18*a* is found to enhance wedging of the accessory in opening 30**, likewise increasing friction between the hanger and the accessory.

Tail **12*a* will be appreciated as extending the hook portion into heightened circumscribing relation with display rod 32 and providing for lessened likelihood of undesired separation of the hanger from the display rod. On the other hand, given the lessened thickness of the tail relative to the hook portion at large, as shown in FIG. 5**, the tail is cantilever-supported by the hook portion and deflectable to permit removal of the hanger from the display rod when desired.

Various changes to structure and modifications in practice may be introduced in the foregoing embodiment and practice without departing from the invention. Thus, the particularly discussed and depicted embodiment is intended in an illustrative and not in a limiting sense. The true spirit and scope of the invention is set forth in the following claims.

We claim:

1. A garment accessory hanger comprising an integral frame having a hook portion and a body portion, said body portion defining an upper transverse marginal course, a lower transverse marginal course and opposed first and second side marginal courses interconnecting said upper and lower transverse marginal courses, and first and second deflectable arms extending respectively from said first and second side marginal courses, ends of said arms being mutually spaced, said upper transverse marginal course and said first and second arms bounding a first opening in said body portion, said lower transverse marginal course and said first and second arms bounding a second opening in said body portion, said first opening being of lesser area than said second opening. said first and second arms having respective surfaces bounding said first opening which are parallel with an undersurface of said upper transverse marginal course bounding said first pening, said first and second arms having respective surfaces bounding said second opening which extend at an acute angle with respect to an upper surface of said lower transverse marginal course bounding said second opening, the parallelism of said undersurface of said upper transverse marginal course and said surfaces of said first and second arms bounding said first opening, and the acute angularity of said surfaces of said first and second arms bounding said second opening and the diversity in area as between said first and second openings giving rise to enhanced frictional relation between said hanger and a garment inserted loopwise onto said first and second arms and disposed in said first and second openings.

2. The invention claimed in claim 1 wherein said first opening is of oval configuration and said second opening is of triangular configuration.

3. The invention claimed in claim 2 wherein a transverse dimension of said oval configuration is generally one-half of the height of said triangular configuration.

4. The invention claimed in claim 1 wherein said hook portion is of a first thickness generally thoughout its expanse, with a tail of second thickness less than said first thickness at a free end of said hook portion.

5. A garment hanger comprising a one piece frame having a hook portion and a body portion, said hook portion being of a first thickness generally thoughout its expanse, with a tail of second thickness less than said first thickness at a free end of said hook portion, said tail further being of a width substantially less than the width of said free end of said hook portion.

* * * * *